US006264556B1

(12) United States Patent
Izawa et al.

(10) Patent No.: US 6,264,556 B1
(45) Date of Patent: Jul. 24, 2001

(54) GAMING MACHINE HAVING NOTE HOPPER/DISPENSER

(75) Inventors: Hikaru Izawa; Akiyoshi Isoi, both of Osaka (JP)

(73) Assignee: Japan Cash Machine Co., Ltd., Osaka (JP)

( * ) Notice: Subject to any disclaimer, the term of this patent is extended or adjusted under 35 U.S.C. 154(b) by 0 days.

(21) Appl. No.: 09/037,225

(22) Filed: Mar. 10, 1998

Related U.S. Application Data

(60) Provisional application No. 60/063,439, filed on Oct. 29, 1997.

(51) Int. Cl.[7] ..... A63F 9/24
(52) U.S. Cl. ..... 463/25; 194/206
(58) Field of Search ..... 463/25, 20; 902/23; 194/206

(56) References Cited

U.S. PATENT DOCUMENTS

| | | | | |
|---|---|---|---|---|
| 3,397,763 | * | 8/1968 | Wahlberg | 194/4 |
| 4,658,125 | | 4/1987 | Kachi et al. . | |
| 5,113,990 | | 5/1992 | Gabrius et al. . | |
| 5,271,613 | | 12/1993 | Hain . | |
| 5,290,033 | | 3/1994 | Bittner et al. . | |
| 5,342,049 | | 8/1994 | Wichinsky et al. . | |
| 5,371,345 | | 12/1994 | LeStrange et al. . | |
| 5,458,333 | * | 10/1995 | Takemoto et al. | 273/138 A |
| 5,470,079 | | 11/1995 | LeStrange et al. . | |
| 5,611,535 | | 3/1997 | Tiberio . | |
| 5,630,755 | | 5/1997 | Walsh et al. . | |
| 5,676,231 | | 10/1997 | Legras et al. . | |
| 5,704,835 | * | 1/1998 | Dietz, II | 463/20 |
| 5,895,456 | * | 4/1999 | Beale et al. | 705/39 |
| 6,068,101 | * | 5/2000 | Dickenson et al. | 194/206 |

FOREIGN PATENT DOCUMENTS

| | | |
|---|---|---|
| 4121985 | 7/1992 | (DE) . |
| 19526160 | 1/1996 | (DE) . |
| 0784229 | 7/1997 | (EP) . |

* cited by examiner

*Primary Examiner*—Valencia Martin-Wallace
*Assistant Examiner*—Julia Kasick
(74) *Attorney, Agent, or Firm*—Bachman & LaPointe, P.C.

(57) ABSTRACT

A gaming machine, such as for example a slot machine, including a bill validator to accept paper currency to obtain game play credits, and a note hopper for dispensing paper currency, bank notes or cash equivalent scrip as at least a portion of the payout.

5 Claims, 5 Drawing Sheets

GAMING MACHINE HAVING NOTE HOPPER/DISPENSER

PRIORITY

The instant application claims priority of Applicant's Provisional Application No. 60/063,439 filed Oct. 29, 1997.

FIELD OF THE INVENTION

The present invention is generally directed to the field of gaming machines commonly known as slot machines, and in particular, to such machines including a note hopper for dispensing paper currency, bank notes or cash equivalent scrip as at least a portion of the payout.

BACKGROUND OF THE INVENTION

There are a variety of types of coin operation based slot or gaming machines in widespread use, including for example rotating reel mechanical slot machines, electronic reel machines and video poker machines.

In a basic mechanical slot machine, the player inserts a coin and pulls down on the slot machine handle or presses a button to initiate the game. For a rotating reel machine, three or more parallel, rotatable reels with an assortment of fruit, number and/or bar symbols are then caused to spin until each reel reaches a resting position. The success or failure of the game is then determined by comparing the combination of reel symbols across an active payline with a table of winning combinations posted on the slot machine. The basic mechanical slot machine windows are frequently made large enough to show three or more adjacent symbols on each reel and thereby allow betting involving multiple rows or paylines.

There have been many improvements to the basic slot machine, including the use of video monitors to display an imitation of the parallel, rotatable reels, rather than having actual reels themselves. In operation, these electronic slot machines simulate the rotation of a physical reel, but typically select the final symbols through use of random numbers generated by a microprocessor rather than any physical rotation of reels. In other words, the final symbols for each simulated reel in the electronic slot machine are randomly selected by the microprocessor and then displayed on the video monitor at the appropriate time and position.

Gaming machines manufactured prior to 1990 generally allowed only for the player to deposit coins or tokens to initiate a new game. Typically such slot machines accept coins or tokens of only one denomination to play a game. The accepted coins are stored in a coin hopper contained in the machine. Because these machines accepted coins of only a single denomination, a player must have that denomination of coin to play the slot machine. Casinos may employ personnel to provide change for bills to players at the slot machines so that the players do not have to leave the machines if they wish to continue playing, but do not have the correct denomination of coin. Winning game plays are determined randomly by the slot machine which pays out to the winner coins from the coin hopper. Coins dispensed from the coin hopper fall into a payout tray, where they can be collected by the player or used to initiate a new game.

Gaming machines may also have a game credit meter visible to the player which is incremented in the amount corresponding to the number of coins inserted by the player or added as specified by the outcome of a winning game. Game credits can be cashed out for the corresponding number of coins, or used to initiate a subsequent game. The play and payout functions are activated by specific operator switches on the face of the gaming machine, accessible to the player, which in turn are connected to a microprocessor based controller within the gaming machine. The microprocessor based controller also controls the operation of the coin hopper in the gaming machine. The coin hopper is thus the coin receiver, coin storage and coin dispenser for the gaming machine.

In approximately 1990, it became increasingly common for the manufacturers of gaming machines to incorporate currency validation devices or bill validators into the gaming machines. The bill validators allow a player to insert paper currency directly into the gaming machine. The bill validator devices are mounted either inside of the gaming machine, or externally in close proximity to the gaming machine. Upon receipt of the paper currency and verification by the bill validator, an output signal from the bill validator instructs the controller of the gaming machine to issue credits based on the denomination of the deposited currency. Credits are thus incremented onto the credit meter without a player having to physically insert coins. The use of bill validators eased new game initiation and enhanced player retention.

However, the gaming machines which have bill validators generally allow for player payout or cashouts only in the form of coins. Due to the convenience afforded the player through the use of the bill validator, fewer coins are utilized to initiate new games and also thereby replenish the coin supply in the coin hopper. Thus, a constantly depleting supply of coins within the coin hopper available for payouts has been the typical result. By comparison to older machines which did not allow for acceptance of paper currency, the operators of gaming machine which have bill validators have had to manually fill the coin hopper with coins much more frequently when player payouts have emptied the coin supply in the gaming machines.

Casinos have thus had to increase the number of change persons who circulate in the gaming machine area to exchange coins or tokens for currency bills and replenish the coin hoppers. The change persons must oversee and distribute a large number of coins of varying denominations. Very often a casino will have gaming machines that accept, for example, nickels, quarters, fifty cent pieces or dollar coins as well as dollar, five dollar, twenty five dollar or one hundred dollar tokens. In addition to the inherent problems of carrying about a large amount of change on the casino floor, this method of supplying both machines and players with change complicates the accounting procedures, increases security concerns and requires more personnel.

SUMMARY OF THE INVENTION

In recognition of a need to alleviate the necessity of constantly resupplying the coin hopper in gaming machines equipped with bill validators, it has been conceived that such gaming machines would benefit by incorporation of a cash dispenser or "note hopper" mounted either internally or externally to the gaming machine. The note hopper allows for player payout in the form of paper currency, bank notes, coupons, scrip, or other "secure" paper with an associated cash value. The note hopper is connected to the microprocessor based controller of the gaming machine. Player payout will still be controlled by the microprocessor controller, but the controller can allocate the payment to be provided in paper or coin form, or a combination of paper and coins.

To a substantial degree, equipping the gaming machine with a note hopper balances the quantity of coins paid out by the gaming machine to the coins inserted into the gaming machine. Incorporation of the note hopper will thus have the beneficial result that the frequency of manual coin hopper fill operations will be substantially reduced. In addition, the design of coupons or scrip used instead of currency would preferably be unique to the casino and accepted by other bill validators in use in the casino. When such scrip is used as the payout media, the amount of actual currency held in the gaming machines may be substantially reduced.

The note hopper is envisioned to have two primary component assemblies, herein being referred to as the note cassette and the transport assembly. The note cassette is simply a removable, replaceable storage device to hold, in a secure fashion, a supply of paper currency, or alternative paper medium to be dispensed. The transport assembly includes the mechanical and electrical components to allow the paper currency to be extracted from the note cassette, transported, and dispensed by the gaming machine upon instructions by the microprocessor or alternate controller of the gaming machine. The note hopper also incorporates the electronic circuits necessary to allow for secure communication of instruction or commands, as well as to monitor and provide status messaging to the controller of the gaming machine.

DETAILED DESCRIPTION OF THE PREFERRED EMBODIMENT

Figure 1:
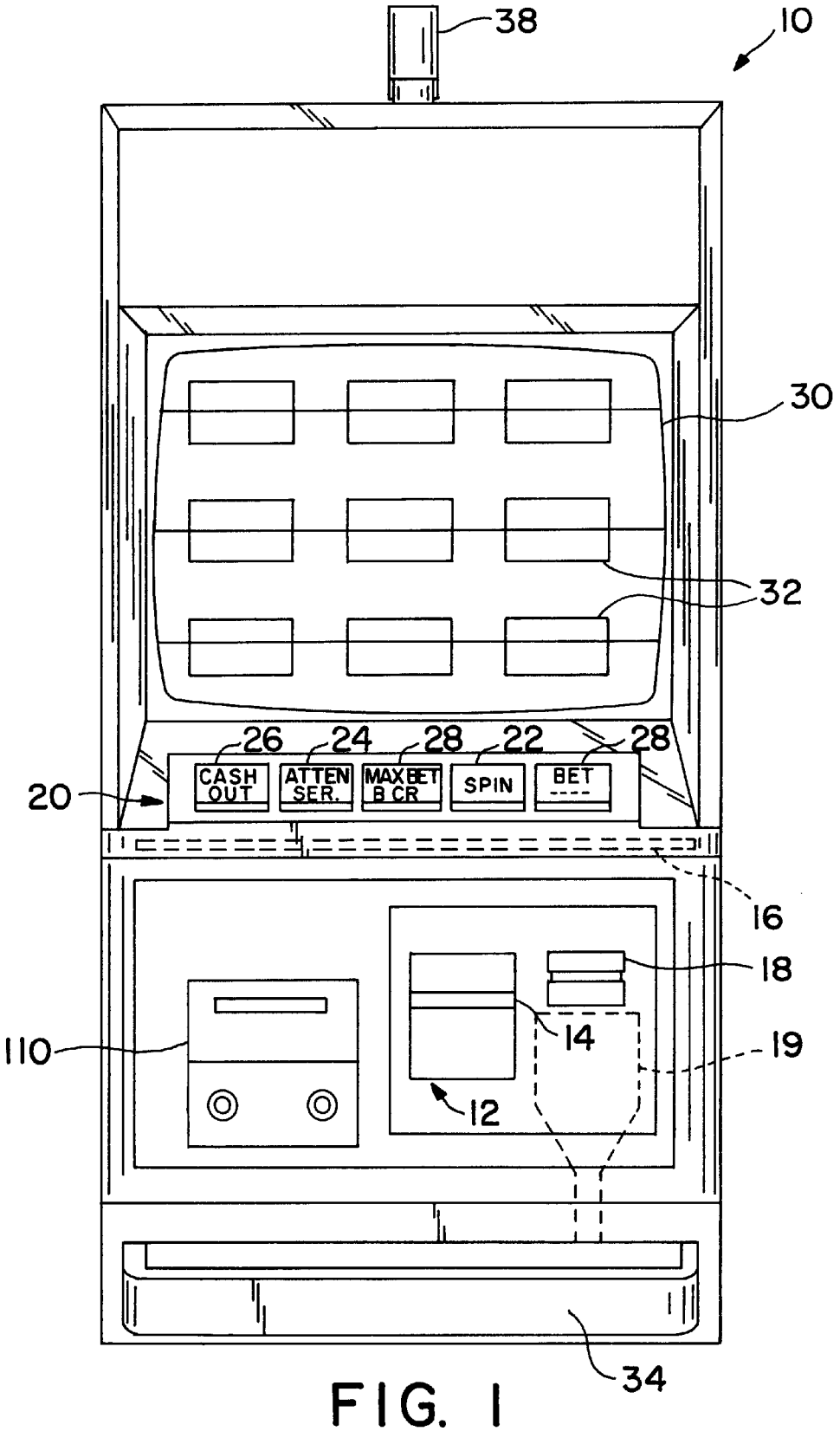
FIG. 1 depicts a gaming machine of the present invention.

Referring now to FIG. 1, an exemplary form of an electronic slot or gaming machine 10 of the present invention is shown. Like slot machines generally, the gaming machine 10 collects money, initiates game play, illustrates game play and provides a payout for successful game play. The gaming machine 10 includes a bill validator 12, provided to accept money in slot 14 in the form of bills of various denominations. Suitable bill validator for the gaming machine 10 of the present invention are manufactured by Japan Cash Machine of Kanagawa in Osaka, Japan.

The bill validator 12 pulls in paper currency, bank notes, bills or other cash equivalent secure paper as discussed herein, determines the denomination of the bills and determines whether the bills are valid. If a bill is invalid, it will be ejected by the bill validator 12 and thus returned to the player through slot 14. To the extent valid bills are inserted into the bill validator 12, bill validator 12 will retain them and communicate their acceptance to the microprocessor controller 16 within the gaming machine 10.

In addition, the gaming device 10 includes a coin acceptor 18 and coin hopper 19 (shown schematically) which accepts and collects coins, count coins, validates coins and stores coins. Information concerning the amount and validity of coins ascertained by the coin acceptor 18 is communicated to the microprocessor controller 16. As an alternative, the bill validator 12 can be configured to accept coded coupons, scrip or secure paper issued by the casino, to allow a player to obtain credits on the gaming machine 10 without depositing either currency or coins.

If sufficient bills, coins or credits have been inserted into the gaming machine 10, the microprocessor controller 16 will allow game play to be initiated. A "play" or "spin" button 22 located on the button panel 20 of the gaming machine 10 will be lit and enabled by the microprocessor based controller 16. This "spin" button 22 serves as a switch to allow the player to initiate game play simply by pressing it. The gaming machine 10 could alternatively, or in addition, include a handle (not shown) which the player would pull to initiate play.

Additionally the button panel 20 may have a call button 24, cash out button 26 and multiple bet buttons 28 to allow the player to call the attendant, cash out any accumulated winnings or make multiple bets before initiating game play. These additional buttons 24, 26, 28 are also linked to and controlled by the microprocessor controller 16 and lit during game play, particularly when their functions are available for activation by the player.

The gaming machine also features a display area, such as a video display 30 which may include one or more rows of display boxes 32, where the results of each play are displayed. Further, the gaming machine 10 includes a payout tray 34 into which coins are dispensed upon a winning play, or when the player decides to cash out by pressing the cash out button 26. In order to stimulate game play and generate excitement, the gaming machine 10 preferably also includes a lamp and sound generator 38, which is controlled by the microprocessor controller 16.

The present invention contemplates adding to the gaming machine 10 a note hopper 110 to store and dispense paper currency, bank notes or "secure" paper such as printed coupons or scrip issued by the casino. Such currency is conveniently dispensed from slot 120 of the note hopper 110, so that it may be accepted by the player. The note hopper 110 is connected to and controlled by electronic instructions from the microprocessor controller 16 of the gaming machine 10. When non-currency secure paper is to be dispensed, it preferably incorporates in its design and/or manufacture, characteristics to allow it to be scrutinized and validated by bill validators and other electronic currency validation, stacking and sorting devices, incorporated in gaming machines and cashier stations in the casino.

Figure 2:
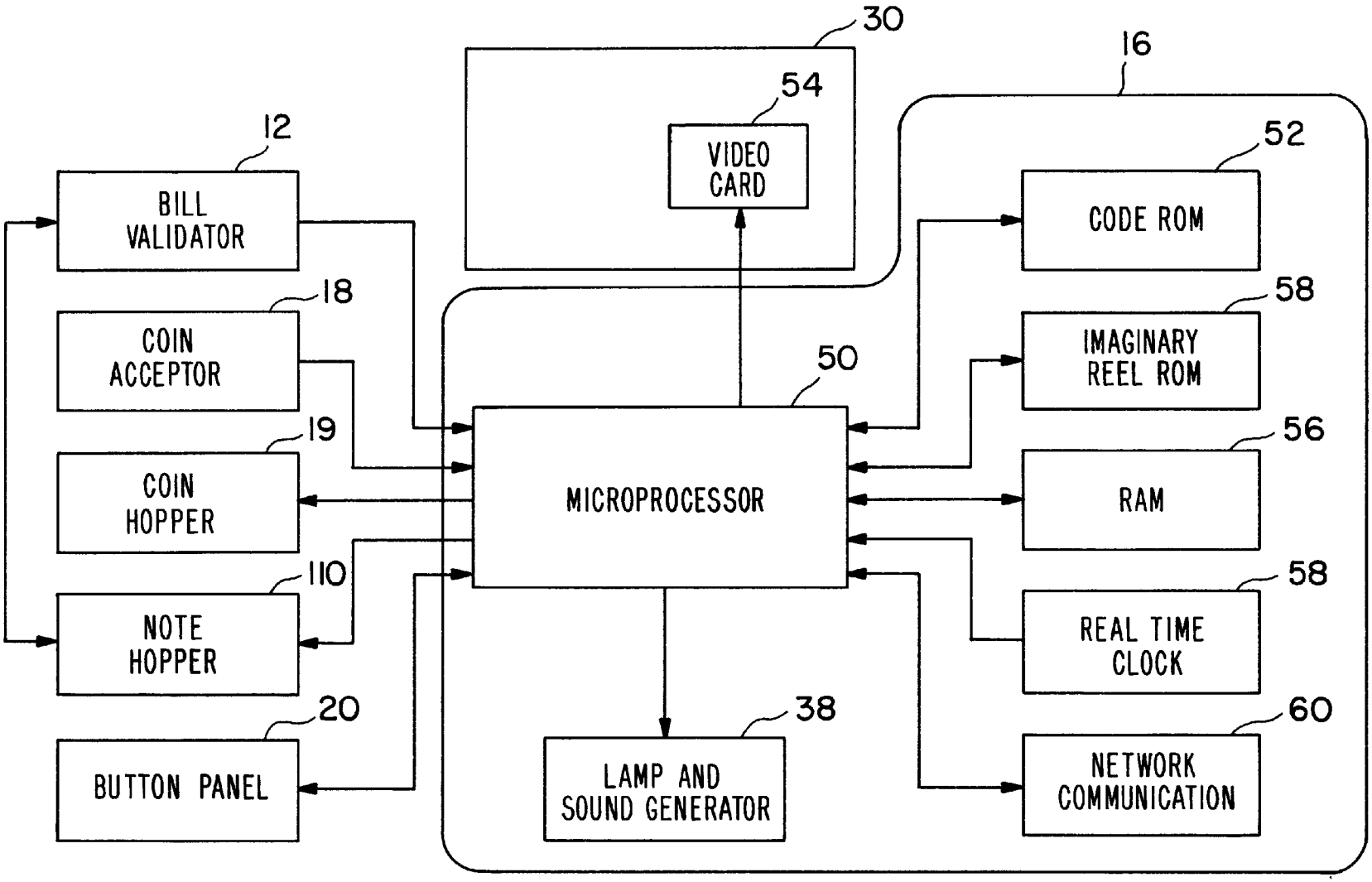
FIG. 2 is a block diagram of the electronic control system of the gaming machine of FIG. 1.

FIG. 2 is a block diagram which schematically shows the microprocessor based controller 16 for the gaming machine 10 of the present invention. At the heart of the controller 16 is a microprocessor 50. The microprocessor 50 relies upon programming instructions stored in a code read-only memory (ROM) 52 to execute the game play sequence and appropriate video displays and activation of the button panel 20.

The microprocessor 50 is connected to control and receives signals from the bill validator 12, coin acceptor 18, coin hopper 19, to collectively accept coins and bills deposited by a player. In addition, the microprocessor 50 is connected to control and direct signals to and from the button panel 20 video monitor 30, and the lamp and sound generator 38. Further, the microprocessor 50 is connected to the note hopper 110, which in turn may also be connected to the bill validator 12, as shown, so that the two components can share control functions relating to the validation proceedings for bills and notes.

When game play is initiated by pressing the spin button 22, the microprocessor 50 uses information stored in a video card 54 to simulate a symbol spinning motion in all of the display boxes on the video monitor 30. The video card 54 contains a symbol graphic erasable, programmable read-only memory (EPROM), a static graphics EPROM and a random access memory (RAM). The microprocessor 50, in conjunction with a separate RAM 56, simultaneously generates one or more random numbers which will be used to designate the symbols to be displayed upon completion of the spin. This RAM 56 may suitably take the form of a non-volatile RAM chip. A real time clock 58 may advantageously be used to assist the microprocessor 50 generate random numbers by tying the random number generation algorithm to the time of day. This real time clock 58 can also be helpful in generating game histories for storage in RAM 56 or transmission through network communications 60.

Figure 3:
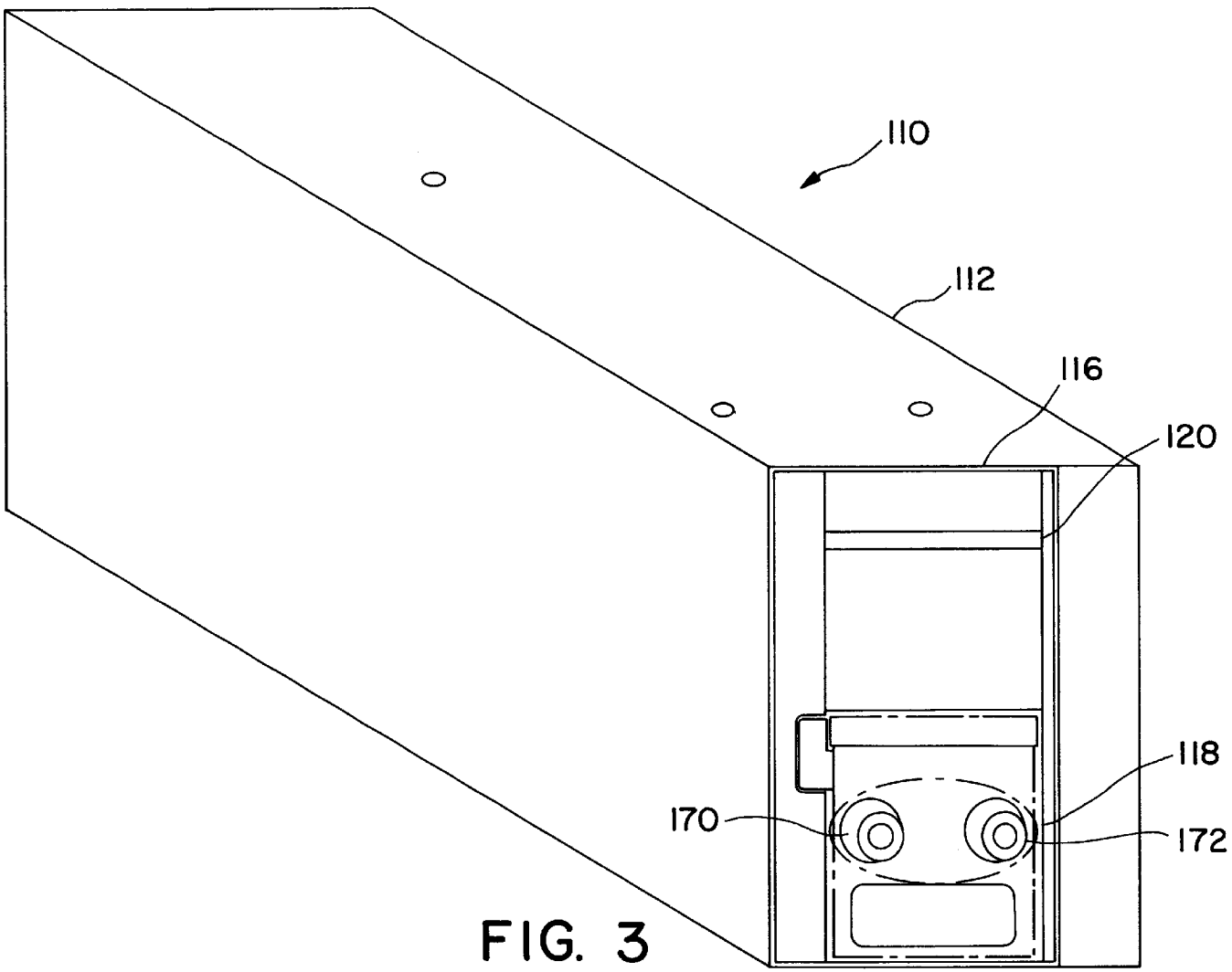
FIG. 3 depicts a perspective view of the note hopper for the gaming machine of FIG. 1.

FIG. 3 depicts the note hopper 110 removed from the gaming machine 10 of FIG. 1. The note hopper 110 includes a chassis 112 designed to be secured into the gaming machine 10. The chassis 112 contains a transport assembly 116 and a currency cassette 118, as shown in FIGS. 4 and 5, respectively.

Figure 4:
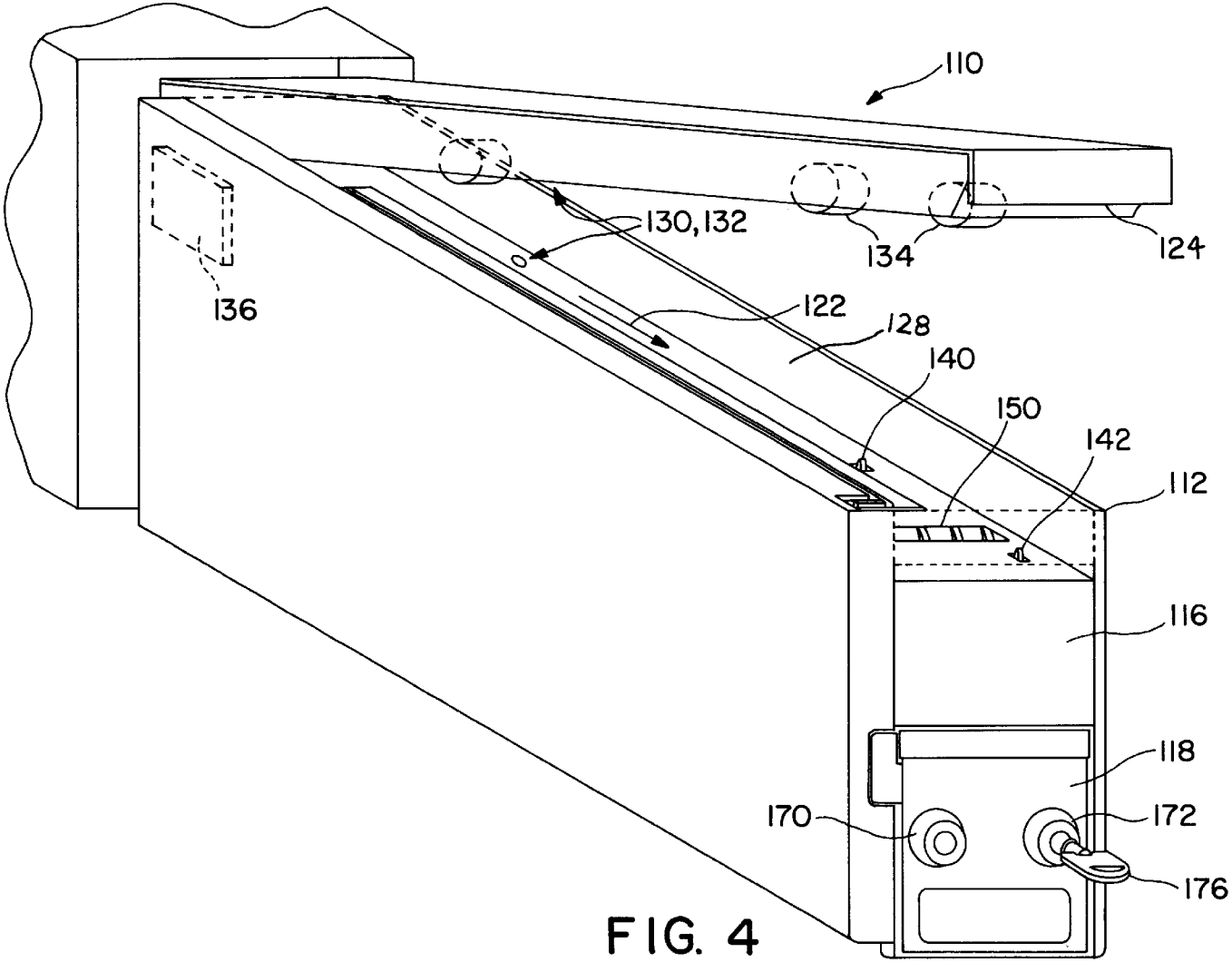
FIG. 4 depicts a partially exploded view of the note hopper of FIG. 3 illustrating details of the transport assembly of the note hopper.
Figure 5:
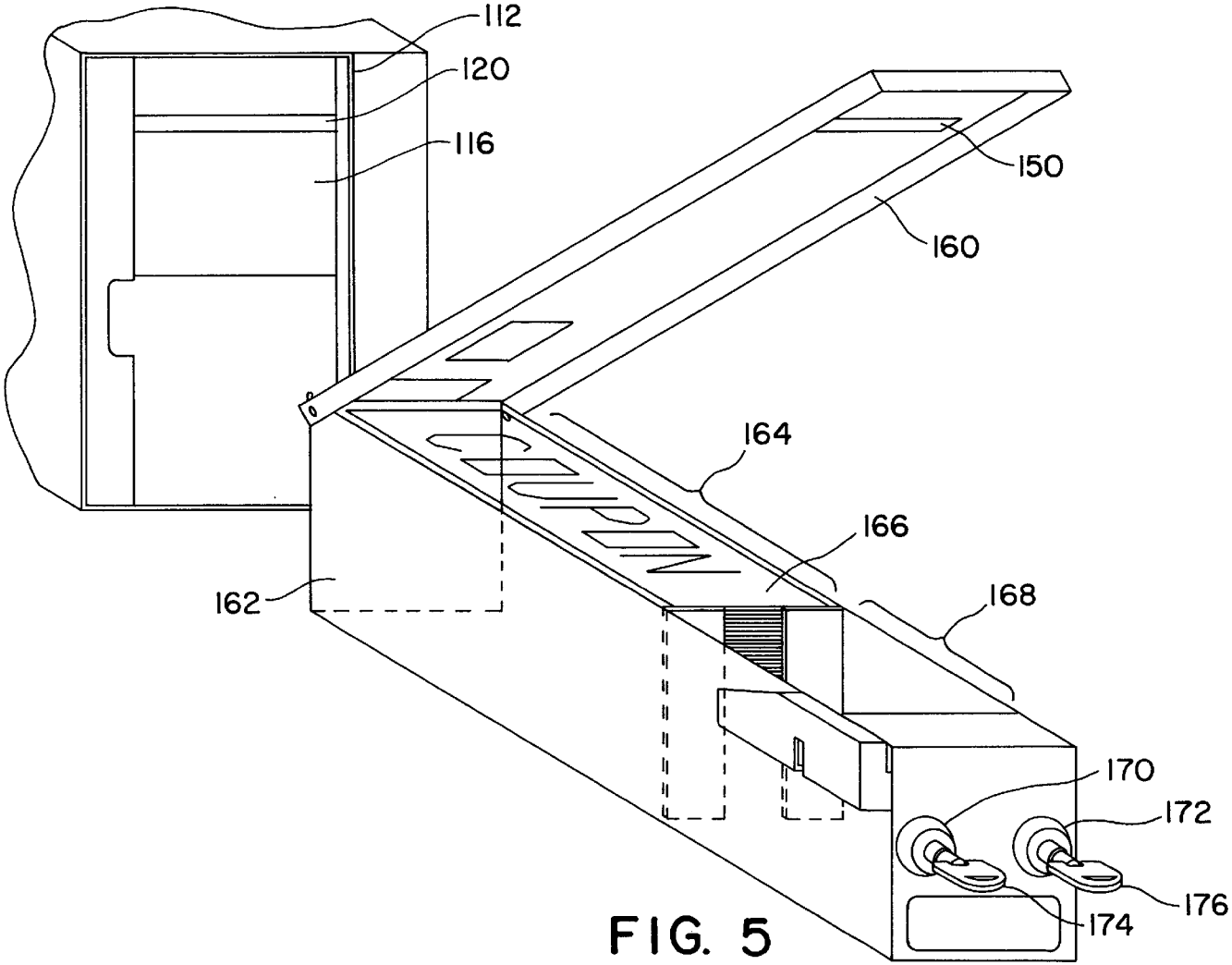
FIG. 5 depicts a perspective view of the currency cassette of the note hopper extracted from the transport assembly of FIG. 4.

As depicted in FIG. 3 and in the view of FIG. 4, the transport assembly 116 includes the slot 120 from which currency can be dispensed. The slot 120 for dispensing currency is the opening at the external end of a transport path 122 defined by a drive transport assembly 124 which generally comprises a lid assembly 126 and a transport shelf 128. The lid assembly 126 and transport shelf 128 may include one or more sensors 130, 132, such as infra red, magnetic or optical sensors, for detecting passage and authenticating each bill or note which is dispensed. The transport assembly 116 preferably includes "double-bill" check and detection systems to guarantee that each bill or note is dispensed individually, and that double bills are not dispensed. In the event that a double bill detection event occurs, the transport assembly 116 diverts the double bill to a storage area in the note hopper 110, by redirecting the travel path of the double bill so that it is not dispensed from the gaming machine 10. The lid assembly 126 of the transport assembly 116 may also include one or more drive rollers 134 which include associated drive mechanisms or motors (not shown).

The transport shelf 128 may also include one or more mechanical feed-out lever sensors 140, to detect the position of the bill or note during transport. In addition, the transport shelf 128 may include one or more mechanical lever sensors 142, which prevent dispensing of a subsequent note prior to removal of a preceding note.

The sensors 130, 132 lever sensors 140 and 142 and the drive mechanisms or motors are electronically controlled by an electronic controller 136 within the note hopper 110. The electronic controller 136 provides control functions, communications with the microprocessor controller 16 and the bill validator 12 of the gaming machine 10.

As depicted in FIG. 4, the transport shelf 128 may also include a diverter slot 150 which provides an opening to a path for allowing a double bill or other rejected note to be stored in the note hopper 110.

FIG. 5 depicts a perspective view of the currency cassette 118 extracted from the transport assembly 116. The currency cassette 118 includes a lid 160 attached to a frame 162. The frame 162 includes a currency storage hopper 164 which allows the storage of a plurality of coupons, currency, notes or bills 166. At the front portion of the currency cassette 118 is a rejected note storage area 168 which is positioned immediately below the diverter slot 150 of the transport shelf 128 upon installation of the currency cassette 118 into the transport assembly 116.

Preferably, the currency cassette includes double lock assemblies 170 and 172. A double lock configuration allows the first lock assembly 170 to be used to secure the currency cassette 118 within the transport assembly 116, while the second lock assembly 172 secures the lid 160 to the frame 162. The double lock assembly also requires two keys 174 and 176 respectively, to open the currency cassette 118 and allow access to the currency storage area 164.

The note hopper 110 would be conventionally incorporated inside of an electronically controlled gaming machine 10, which could alternatively be a spinning reel slot machine, video poker game, etc; to allow for payback to the player in the form of paper currency. The note hopper 110 allows for a higher degree of flexibility in player payback, resulting in fewer instances of manual filling of the coin hopper of the gaming machine 110.

The note hopper 110 is designed to dispense notes or currency of a single denomination, which can be matched to the coin accepted by the gaming machine 10 for each play. Thus, for example, twenty-five cent machines may include a note hopper 110 loaded to dispense $10 or $20 bills, while the $1 and $5 machines would have a note hopper 110 loaded to dispense $50 or $100 bills.

As an example of how the note hopper 110 would be incorporated into the payout operation of a gaming machine 10, following a "jackpot" play, the microprocessor controller 16 of the gaming machine 10 causes an accumulation of winnings to be displayed as credits. In the event that the player wishes to receive the accumulated winnings, as opposed to continuing play using the credits, the player presses the cash out button 26 on the button panel 20. The microprocessor controller 16 then instructs the coin hopper 19 to dispense a certain percentage of the winnings as coins dispensed to the payout tray 34, while the remainder of the winnings, in increments corresponding to the denomination of the notes held in the note hopper 110, would be dispensed by the note hopper 110 as the correct number of bills through slot 120. During this procedure, the transport assembly 116 sequentially removes bills from the currency cassette 118, verifies that only one bill has been removed by sensing characteristics of the bill via sensors 130 and 132, and sequentially dispenses the bills through slot 120.

Upon the dispensing of each bill, the note hopper confirms that the bill has been dispensed to the microprocessor controller 16 so that the displayed credits can be reduced accordingly. Alternatively, the microprocessor controller 16 of the gaming machine 10 could cause the coin hopper 19 and note hopper 110 to operate simultaneously, or sequentially, to payout a jackpot automatically, instead of by displaying credits and a partial payout. In either case, the microprocessor 16 would also initiate operation of the light and sound generator 38, announcing the jackpot won by the player.

The note hopper 110 can also be configured in gaming machines 10 such that "secure" paper such as coupons, scrip 166, having exchangeable monetary value within the casino, could be dispensed, for example upon activation of the "cash out" button 26 as discussed above. Such secure paper 166 would be designed to be inserted into the currency accepter or bill validator 12 of gaming machines 10, including other such gaming machines within a gaming establishment, to allow a player to obtain credits on various gaming machines without the transfer of genuine paper currency. The use of such secure paper 166 as the payout medium provides substantial economic advantages for the gaming establishment, due principally to the reduction in the amount of paper currency in circulation.

The above-mentioned implementations of the note hopper 110 specific to the gaming industry could be either designed and manufactured as an integral component of gaming machines 10, as shown in FIG. 1, or designed as a retrofit component to be either internally or externally mounted to gaming machines already installed and operational in gaming establishments.

The foregoing detailed description is provided to allow those skilled in the art to appreciate the present invention. It is contemplated, however, that such persons will readily understand the application of the note hopper detailed herein in various types of gaming machines which are available. Therefore, the invention and protection afforded by this disclosure will properly be understood to be limited and defined only by the scope of the appended claims.

What is claimed is:

1. A gaming apparatus comprising:

a button panel including a display and a user interface area for allowing an operator to play a game of chance;

a bill validator incorporated into said apparatus for accepting and validating currency to credit the user with a corresponding number of play credits for the gaming apparatus;

a note dispenser for dispensing currency as payout for successful play, said note dispenser comprising a currency cassette removable attached to said note dispenser for containing a plurality of currencies, and a transport assembly for transporting notes within said currency cassette to a dispensing slot via a transport path; and a sensor for detecting multiple notes within the transport path;

said currency cassette being positioned below said transport assembly;

said currency cassette comprising a frame, a lid attached to said frame, a currency storage hopper defined in said frame, and a rejected note storage area at a front portion of said currency cassette, wherein said transport assembly sequentially removes bills from said currency storage hopper of the currency cassette, verifies that only one bill has been removed by sensing characteristics of the bill via sensors, and sequentially dispenses the bills through the dispensing slot so that said multiple notes are transported by said transport assembly to the rejected note storage area in said currency cassette to preclude dispensing of said multiple notes upon detection of the multiple notes by said sensor.

2. The gaming apparatus of claim 1, wherein said transport assembly comprises a transport shelf which includes said sensor, and a diverter slot which provides an opening to a path for allowing a double bill or other rejected note to be stored in said rejected note storage area.

3. The gaming apparatus of claim 2, wherein said rejected note storage area is positioned immediately below said diverted slot of the transport shelf upon installation of the currency cassette into the transport assembly.

4. The gaming apparatus of claim 1, wherein said currency cassette includes double lock assemblies.

5. The gaming apparatus of claim 4, wherein said double lock assemblies comprises a first lock assembly to be used to secure the currency cassette within the transport assembly, and a second lock assembly secures said lid to the frame.

* * * * *